United States Patent [19]

Kern et al.

[11] Patent Number: 4,701,624

[45] Date of Patent: Oct. 20, 1987

[54] FIRE SENSOR SYSTEM UTILIZING OPTICAL FIBERS FOR REMOTE SENSING

[75] Inventors: Mark T. Kern, Goleta; Steven E. Hodges, Santa Barabara; Danny G. Snider, Ventura; Kenneth A. Shamordola, Santa Barbara, all of Calif.

[73] Assignee: Santa Barbara Research Center, Goleta, Calif.

[21] Appl. No.: 793,609

[22] Filed: Oct. 31, 1985

[51] Int. Cl.[4] ..... H01J 5/16

[52] U.S. Cl. ..... 250/554; 250/227; 250/339; 340/578; 340/587

[58] Field of Search ..... 250/227, 339, 554; 340/578, 587

[56] References Cited

U.S. PATENT DOCUMENTS

| | | | |
|---|---|---|---|
| 4,206,454 | 6/1980 | Schapira et al. | 250/339 X |
| 4,220,857 | 9/1980 | Bright | 250/339 |
| 4,328,488 | 5/1982 | Yanai et al. | 250/554 X |
| 4,370,557 | 1/1983 | Axmark et al. | 250/554 |

*Primary Examiner*—Eugene R. LaRoche
*Assistant Examiner*—James C. Lee
*Attorney, Agent, or Firm*—Ronald L. Taylor; A. W. Karambelas

[57] ABSTRACT

A fire sensing system utilizing fiber optics to extend the physical range of radiation sensing elements into areas and environments which are physically inaccessible to, and/or destructive of, such sensors and their associated electronic circuitry. The fiber optics are combined with signal processing circuitry to achieve reliable fire sensing systems which present particular advantages in special applications.

38 Claims, 7 Drawing Figures

FIRE SENSOR SYSTEM UTILIZING OPTICAL FIBERS FOR REMOTE SENSING

BACKGROUND OF THE INVENTION

1. Field of the Invention

This invention relates to fire sensing systems and, more particularly, to such systems for special applications utilizing fiber optics in conjunction with related circuitry to discriminate between stimuli from fire and non-fire sources.

2. Description of the Related Art

Sensing the presence of a fire by means of photoelectric transducers is a relatively simple task. This becomes more difficult, however, when one must discriminate reliably between stimuli from a natural fire and other heat or light stimuli from a non-fire source. Radiation from the sun, ultraviolet lighting, welders, incandescent sources and the like often present particular problems with respect to false alarms generated in fire sensing systems.

It has been found that improved discrimination can be developed by limiting the spectral response of the photodetectors employed in the system. Pluralities of signal channels having different spectral response bands have been employed in a number of prior art systems which utilize different approaches to solving the problem of developing suitable sensitivity for fire sensing while reliably discriminating against non-fire stimuli. The disclosed solutions, however, have not attempted to do such at remote locations where the only view of a fire is over presently available fiber optic cable. The limitations imposed by such fiber optic cable as is now commercially available render many techniques inapplicable.

The Cinzori U.S. Pat. No. 3,931,521 discloses a dual-channel fire and explosion detection system which uses a long wavelength radiant energy responsive detection channel and a short wavelength radiant energy responsive channel and imposes a condition of coincident signal detection in order to eliminate the possibility of false triggering. Cinzori et al U.S. Pat. No. 3,825,754 adds to the aforementioned patent disclosure the feature of discriminating between large explosive fires on the one hand and high energy flashes/explosions which cause no fire on the other. However, this general system is not readily convertible to more specialized fiber optic fire sensor system applications, such as the present invention, due to the lack of available optical fibers capable of transmitting long wavelengths.

U.S. Pat. No. 4,296,324 of Kern and Cinzori discloses a dual spectrum infrared fire sensing system in which a long wavelength channel is responsive to radiant energy in a spectral band greater than about 4 microns and a short wavelength channel is responsive to radiant energy in a spectral band less than about 3.5 microns, with at least one of the channels responsive to an atmospheric absorption wavelength which is associated with at least one combustion product of the fire or explosion to be detected.

McMenamin, in U.S. Pat. No. 3,665,440, discloses a fire detector utilizing ultraviolet and infrared detectors and a logic system whereby an ultraviolet detection signal is used to suppress the output signal from the infrared detector. Additionally, filters are provided in series with both detectors to respond to fire flicker frequencies of approximately 10 Hz. As a result, an alarm signal is developed only if flickering infrared radiation is present. A threshold circuit is also included to block out low level infrared signals, as from a match or cigarette lighter, and a delay circuit is incorporated to prevent spurious signals of short duration from setting off the alarm. However, such a system may be confused by other flickering sources as simple and common as sunlight reflected off a shimmering lake surface or a rotating fan chopping sunlight or light from an incandescent lamp.

Muller, in U.S. Pat. Nos. 3,739,365 and 3,940,753, discloses fire detection systems utilizing separate photoelectric sensors respectively responsive to red and blue light radiation. Signals from the sensors are applied in a difference amplifier circuit which generates an alarm signal in one of these systems when the respective signals differ by more than a predetermined amount from a selected value or range of values. In the other system, dual output signals from the difference amplifier are applied to a phase comparator with parallel threshold detectors. The output includes a timing circuit to preclude alarms from short duration disturbances. An alarm signal is provided only if the input signals are in phase, of amplitude in excess of the threshold level, and of sufficient duration to exceed the preset delay. However, such a system may be ineffective in discriminating against non-fires, such as a jet engine exhaust (which has a flicker content), in the presence of scintillating or cloud-modulated sunlight.

The Paine U.S. Pat. No. 3,609,364 utilizes multiple channels specifically for detecting hydrogen fires on board a high altitude rocket with particular attention directed to discriminating against solar radiation and rocket engine plume radiation.

The Muggli U.S. Pat. No. 4,249,168 utilizes dual channels respectively responsive to wavelengths in the range of 4.1 to 4.8 microns and 1.5 to 3 microns. Signals in both channels are subjected to a bandpass filter with a transmission range between 4 and 15 Hz for flame flicker frequency response. Both channels are connected to an AND gate so that coincidence of detection in both channels is required for a fire alarm signal to be developed.

The Bright U.S. Pat. No. 4,220,857 discloses an optical flame and explosion detection system having first and second channels respectively responsive to different combustion products. Each channel has a narrow band filter to limit spectral response. Level detectors in each channel signal detected radiation in excess of selected threshold levels. A ratio detector provides an output when the ratio of signals in the two channels exceeds a certain threshold. When all three thresholds are exceeded by detected radiation, a fire signal is produced.

Other fire alarm or fire detection systems are disclosed in MacDonald U.S. Pat. No. 3,995,221, Schapira et al U.S. Pat. No. 4,206,454, Steel et al U.S. Pat. No. 3,122,638, Krueger U.S. Pat. Nos. 2,722,677 and 2,762,033, Lennington U.S. Pat. No. 4,101,767, Tar U.S. Pat. No. 4,280,058, and Nakauchi U.S. Pat. Nos. 4,160,163 and 4,160,164.

There are certain specialized applications which could benefit from the use of optical fibers in conjunction with the technology discussed hereinabove. An example of one such specialized application is a vehicle fire sensing system for use on aircraft, in particular for monitoring the numerous isolated compartments such as in fuel cells which need to be protected from fires or explosions. Many of these compartments have high ambient temperatures that exceed the maximum upper limit of electronic components, thus militating against the placement of sensors directly therein. Not all optical fibers are suitable for such special applications, however. Certain published studies of the use of fiber optics in aircraft fire sensing systems have concluded that they are not feasible. See reports by HTL Industries, Inc.: "Applicability of Fiber Optics to Aircraft Fire Detector Systems", AFAPL-TR-78-84, Oct., 1978; "Test and Evaluation of U.V. Fiber Optics for Application to Aircraft Fire Detector Systems", AFWAL-TR-81-2049, June 1981. The present invention is directed to the realization of a suitable fire sensing system utilizing optical fibers which are effective for the purpose with particular adaptation to develop an effective system.

SUMMARY OF THE INVENTION

In brief, particular arrangements in accordance with the present invention combine fiber optics with suitable sensors, electronic circuitry and operational logic adapted to realize the advantages of particular parameters of the fiber optics. One particular embodiment of the present invention has been developed for use with military aircraft, and the embodiment will be described in that context. However, it should be clearly understood that the present invention is not to be limited to any one particular application and that the principles of the invention may have utility in various other applications.

The aircraft involved here has numerous isolated compartments, such as in the wing tanks, engine nacelles, and the like. Groups of such compartments can be monitored by separate optical fibers or optical fiber bundles, coupled to a single sensor, thereby reducing the weight requirement for the fire sensing system and enabling the direct monitoring of compartments which have normal operating temperatures that exceed the maximum temperature of sensor circuit components.

Under certain circumstances, man-originated phenomena or occasional natural phenomena can duplicate the characteristics of a fire in the frequency domain. For example, the radiation from a light bulb (or other non-fire source emitting both light and heat) can appear to a detector as fire in the frequency domain if the light is chopped at a constantly varying rate. Sunlight reflecting off ripples on a body of water or transmitted through waves of rising hot air can develop the same effect. It is essential to be able to discriminate between true fire signals and those which constitute false alarms in an effective fire sensing system.

It is one of the requirements for a fire sensing system of the type disclosed herein that it also be able to respond to an explosion within a compartment, such as that produced by an armor-piercing round or anti-aircraft shell that penetrates the compartment, within a few milliseconds and yet also have the capability of responding to a "small" fire, such as one which may develop from leaking fuel or hydraulic fluid contacting a hot manifold in an engine nacelle or the like.

In one particular arrangement in accordance with the present invention, a plurality of optical fibers, preferably arranged in fiber optic bundles, extend from monitoring positions in particular compartments to a dual detector which is responsive separately to short and long wavelength radiation. The separate detector outputs are processed in separate channels of amplifiers and threshold stages and then applied to an AND gate which imposes the requirement that radiation in the two distinct wavelength ranges must be received concurrently in order for the fire sensed signal to be developed. This arrangement also utilizes a comparator for comparing the signals in the two channels and enabling the channels only for detected radiation having a relative amplitude within a predetermined range. The dual channel arrangement is effective for the detection of small fires. In addition, a third path including a threshold circuit is coupled to the long wavelength detector in order to develop a sensor output signal in the event of a high intensity flash, such as is encountered when a round of ammunition penetrates a compartment.

In another arrangement in accordance with the present invention, a similar dual detector is utilized in conjunction with a similar fiber optics arrangement. In this embodiment, the short and long wavelength detectors are coupled in dual channels containing logarithmic amplifiers to provide a ratiometric fire sensor system. The outputs of the logarithmic amplifiers are combined, and the resultant ratio signal is fed through an exponential amplifier to separate high and low threshold stages which in turn feed on OR gate controlling a separate signal path from the long wavelength detector. Only when the ratio of the short to long wavelength radiation signals is within a predetermined range is the path between the long wavelength detector and the sensor output enabled. This embodiment also includes a long wavelength override providing a fire sensed output signal upon detection of the flash from a penetrating round.

In still another arrangement in accordance with the present invention, dual channel detectors in conjunction with optical fiber bundles are utilized in a pair of signal channels providing cross channel signal comparison for limiting the response range of relative amplitudes between the short and long wavelength radiation to predetermined level. This arrangement includes provision not only for detecting high intensity, long wavelength radiation but also determines the response based on the rise time of such radiation signals in order to provide further protection against false alarms.

A further embodiment involves a system including a microprocessor suitably programmed in accordance with the logic employed in the arrangements of the particular circuit embodiment to achieve comparable system performance.

BRIEF DESCRIPTION OF THE DRAWINGS

A better understanding of the present invention may be had from a consideration of the following detailed description, taken in conjunction with the accompanying drawing in which.

DESCRIPTION OF THE PREFERRED EMBODIMENTS

Figure 1:
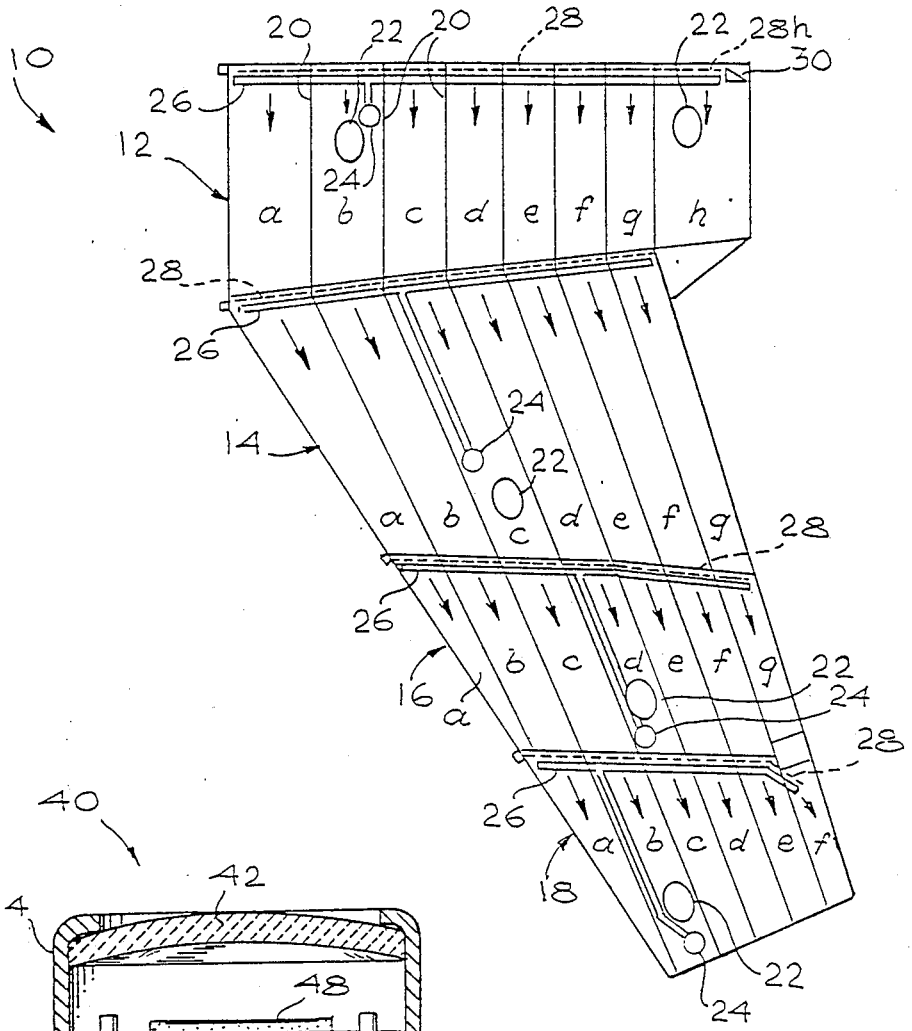
FIG. 1 is a schematic representation of a portion of one particular arrangement in accordance with the invention.

FIG. 1 is a schematic plan view representing a particular aircraft wing in which fiber optic monitoring portions of fire sensing systems in accordance with the present invention may be installed. FIG. 1 shows the wing fuel tank 10 which is divided into 28 separate fuel compartments organized in four major tank sections separated by the wing ribs. The sections are designated by reference numerals 12, 14, 16, and 18 with each of the minor compartments within a section being given a letter designation. The individual compartments, such as 12*a*–12*h*, within a particular section, such as 12, are separated by baffles 20 which, while permitting fuel to drain between all compartments within a given wing tank as well as permitting fire to spread throughout a section once it is started in a given compartment, establish optical isolation for the respective compartments so that it becomes necessary to monitor each of the compartments individually. Similarly, it is necessary, in the event of a sensed fire in one compartment, to distribute fire suppressant into all of the compartments in a given wing tank section. The suppressant is organized between sections, since fire can spread across the wing spars more easily than past the wing ribs.

In FIG. 1, there are five access covers represented by the ovals 22. Fire suppressant bottles are represented by the four circles 24, each of which is coupled to a corresponding pipe distribution manifold 26 extending along an inboard edge of the section and arranged to emit suppressant into each of the individual compartments. Also each section contains a fiber optics bundle 28, represented by the broken lines extending along the manifolds 26. Bundle 28 may contain optical fibers extending to each individual compartment which are arranged to "look" directly into the compartment in the direction of the arrows, generally approximately 90° to the orientation of the bundle 28. This right-angled viewing may be achieved by bending the individual fibers through the appropriate angles or, alternatively, it may be developed by use of a prism or mirror at the end of each individual fiber. One such prism 30 coupled to the optical fiber 28*h* is shown in the fuel compartment 12*h*. Also, instead of a single fiber leading to each individual compartment, a bundle of fibers may be used for monitoring each compartment. A bundle of fibers is generally preferable from the standpoint of strength and effectiveness to a single larger fiber which may not bend as readily and may exhibit a greater tendency to break. Moreover, in a fiber optics bundle, the breaking of one fiber will have less effect than will the severance of a single larger fiber which is the only one monitoring a given compartment.

A system of this type represents a substantial saving in weight and volume as compared with a discrete system of comparable design which would require 28 separate sensors to monitor the tank compartments shown in FIG. 1, or 56 sensors for the 56 compartments in both wings. Moreover, the optical fibers incorporated in such a system are capable of withstanding temperatures beyond 600° C., far above the temperature limit of the sensors and related electronic circuitry. Thus, the present invention can be used with fiber optics extending into engine nacelles and other regions where fire detection is desirable but which customarily operate at temperatures beyond the limits of electronic components.

Figure 2:
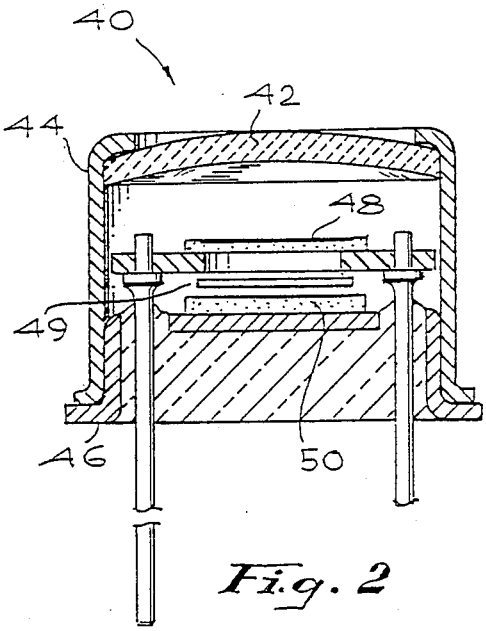
FIG. 2 is a sectional diagram of one particular radiation detector package which may be used in embodiments of the invention.

FIG. 2 illustrates one preferred detector package to which a fiber optic bundle may be coupled in fire sensing systems in accordance with the present invention. The sectional view of FIG. 2 shows a dual detector 40 for coaxial viewing of the radiation emanating from the fiber optics with provision for discrimination between short wavelength and long wavelength radiation. The detector 40 has a window 42 mounted at one end of a "can" housing 44 heremetically sealed to a header base 46. A first detector element 48, which may be of silicon (Si), is mounted nearer the window 42, supported on standoffs from the base 46. A second detector 50, which may be of indium gallium arsenide (InGaAs) is mounted on the base 46.

Figure 3:
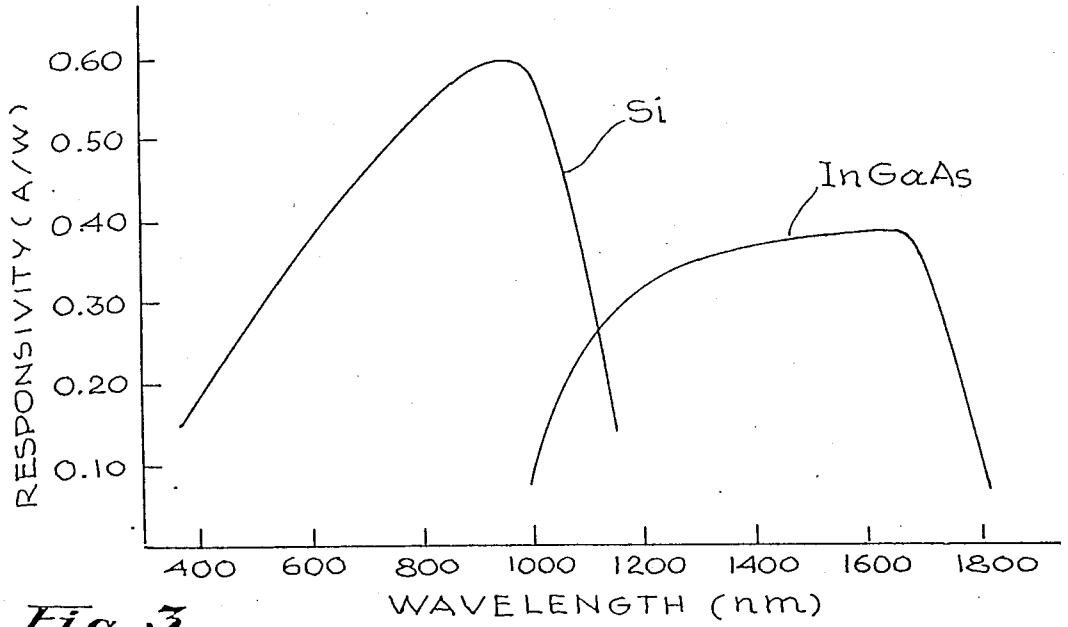
FIG. 3 is a graph showing the performance of the detector of FIG. 2.

The response waveforms for these two detectors 48, 50 are shown as a function of wavelength in the graph of FIG. 3. The coaxial arrangement of the two detectors provides an automatic separation of short wavelength and long wavelength radiation, since the upper detector 48 acts as a window for the lower detector 50 and is opaque to radiation over its range of response. As the radiation wavelength increases to approximately one micron, near the upper limit of the Si response curve, the upper detector 48 begins to be transparent to incident radiation. At this point, the lower detector 50 begins to develop a response signal which corresponds to radiation that falls in the InGaAs response band shown in FIG. 3. Detected radiation signals are fed via suitable conductors to the circuitry comprising the various embodiments of the present invention, as shown in FIGS. 4–7.

Other over/under detector could be used also, including identical detector top and bottom. One example of an identical over/under detector is Si/Si, where the response of the upper detector 48 duplicates that of FIG. 3 while the lower detector 50 response is a narrow spike centered at 1050 nm. Some other detector possibilities are Si/PbS, Si/PbSe, Ge/InAs, Si/thermopile, Ge/thermopile, etc.

Still another arrangement of the detector of FIG. 2 could be configured where an optical filter 49 is inserted between detector 48 and detector 50. Thus the spectral passbands of the two detectors could be separated from each other. For example, a Si/thermopile detector with a 2 micron long pass filter 49 would duplicate the silicon detector response of FIG. 3. However, the thermopile response of detector 50 would begin at 2 microns and continue until optical cutoff of the fiber (about 2.3 microns).

While the responsivities of the two detectors as shown in FIG. 3 overlap in wavelength, the effective centers of the two spectra are different. One is at about 1.4 microns, the other at about 0.8 microns. Other combination of short and long wavelength detectors may be used to improve system operation. It is preferable to separate the short and long wavelength detectors as much as possible while taking care to account for emission line energies. Very good system performance can be achieved with wavelengths at opposite ends of the silica glass fiber transmission band of approximately 0.4 microns to 2.3 microns. In order to separate the response ranges, a "comb" filter can be used to prevent light in the wavelength region from 0.7 to 1.7 microns from reaching the detector, and other detectors may be substituted. Thus, for example, if a silicon/lead sulphide detector were used with the specified comb filter, the silicon detector would only respond to a wavelength range of 0.4 to 0.7 microns, while the lead sulphide detector would only respond to a wavelength range of 1.7 to 2.3 microns. Thus there would be a considerable separation of wavelengths between the long and the short wavelength bands and 1.4 micron emission energy would be excluded. Better system performance may be achieved by operating further in the infrared. A germanium/indium arsenide detector package with a colored glass window (e.g., RG780) yields a 0.8 to 1.8 micron short wavelength band and 1.8 to 2.3 micron long wavelength band. This would include the emission line energy at 1.4 microns in the short wavelength band.

Optical fibers which are presently feasible for use in arrangements of the present invention cut on at about 0.4 microns and have an upper wavelength cutoff at about 2.3 microns. Known optical fibers currently under development which are suitable for use in the present invention may extend the upper cutoff wavelength to approximately 5 microns or 12 microns, depending on the fiber material and length. Other fibers are being developed that transmit ultraviolet (UV) radiation (below 0.3 microns). However, these optical fibers do not have sufficient strength, ruggedness and/or other properties that are required to be generally useful in systems of the present invention.

It should be noted that fibers that transmit further into the IR than 2.3 microns are actively being developed. Fibers made from various fluoride classes, such as zirconium or hafnium fluoride, cut off at about 5 microns. They are being developed mainly for their promise of low loss telecommunications fibers. Fibers made from chalcogenous materials, such as arsenic germanium selenium or germanium selenium antimonide, are being developed for IR radiometric and imaging applications. These fibers cut off at about 10–12 microns. Fibers made from metal halides, such as thallium bromoiodide (e.g, KRS-5), cut off between 12 and 16 microns and are being developed to transmit 10.6 micron laser energy, as well as for other uses. Other IR transmitting fibers are being developed. These fibers will offer more and more advantages for fire sensing systems as they are developed, because of their ability to transmit radiation beyond about 5 microns where solar and artificial light radiation is not readily sensed due to the absorption of intervening media (e.g., atmosphere, glass, etc.) while radiation from a fire is very pronounced and relatively unaffected.

Although UV transmitting fibers are being developed to reduce their losses, the field of view of any system which uses them will continue to be severely impaired.

Figure 4:
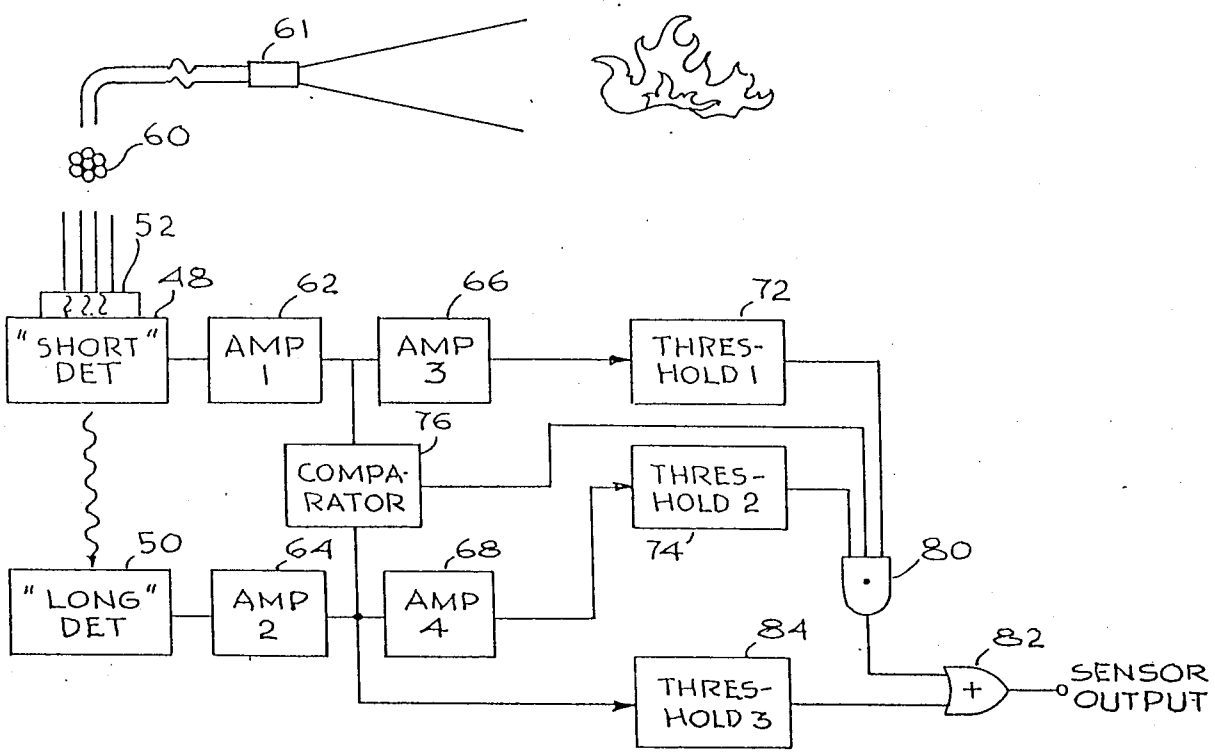
FIG. 4 is a schematic block diagram of one particular arrangement in accordance with the invention.

FIG. 4 represents schematically one particular fire sensing system of the present invention. In this figure, a fiber optic bundle 60, which may comprise a plurality of optical fiber bundles such as those designated 28 in FIG. 1, is shown coupled to coaxial detectors 48 and 50. Coupling optics 52 may be utilized, if needed to match the geometries of the fiber bundle and detector. Also, on the remote end of the fiber optic bundle 60 suitable elements 61 for increasing or decreasing the field of view (FOV) of the optical fibers may be provided, as appropriate. For example, increasing the FOV would allow the system to monitor a large area but limit the sensor range, while decreasing the FOV would allow the system to sense smaller fires, farther away, but at the expense of monitored area.

Each of the detectors 48, 50 generates electrical signals corresponding to the received radiation which is within its range of response. The signals from the respective detectors 48, 50 are applied to input amplifiers 62, 64 in corresponding signal processing channels. The first channel (short wavelength signals) comprises a pair of amplifiers 62, 66 in series with a threshold stage 72. The lower channel, coupled to the long wavelength detector 50, comprises a pair of amplifiers 64, 68 in series with a threshold stage 74. Each of the signal channels is coupled to provide an input to a comparator stage 76, taken from the output of amplifier 62 and amplifier 64. The comparator 76 and the thresholds 72, 74 are coupled to control the output of the AND gate 80 by disabling the gate 80 when the output of the comparator 76 is a logic 0. The output of comparator 76 is a logic 0 when light seen by both detectors 48, 50 is uncharacteristic of a fire (e.g., too much more short wavelength light than long wavelength light or vice versa). When the comparator 76 generates the logic 0, the AND gate 80 cannot indicate a fire by having a logic 1 output. When the radiation level in both detector channels appears as a fire, the comparator output becomes a logic 1, enabling the gate 80.

The outputs of the thresholds 72, 74 are also applied to the AND gate 80, the output of which is applied to an OR gate 82 from which the fire sensed output is taken. The circuit also includes a third threshold stage 84 which is connected between the output of the amplifier 64 and another input to the OR gate 82. The threshold 84 provides a long wavelength override for developing a response to a high intensity radiation, which may result from an incendiary round igniting an explosion or from the explosion itself.

The long wavelength detector 50, via the amplifier 64 and threshold 84, determines the long wavelength override. The level of the threshold 84 is set high enough such that it will not false alarm on sunlight and other potential false alarm sources but is low enough to pass a signal from an explosion or an incendiary round, thereby generating the sensor output from the OR gate 82. The gain of the amplifier 64 and/or the threshold level 84 is set accordingly to provide this discrimination.

The gain of amplifier 62 is set so that the signals from both the short and long wavelength detectors 48, 50 can be amplified to provide the operation described above for the comparator 76. With the gains of the amplifiers 62, 64 thus determined, the gains in the amplifiers 66, 68, along with the threshold levels in stages 72, 74, are adjusted to allow the system to respond to an appropriate size fire with the sensitivity desired (e.g., a five-inch diameter fire at four feet distant).

Figure 5:
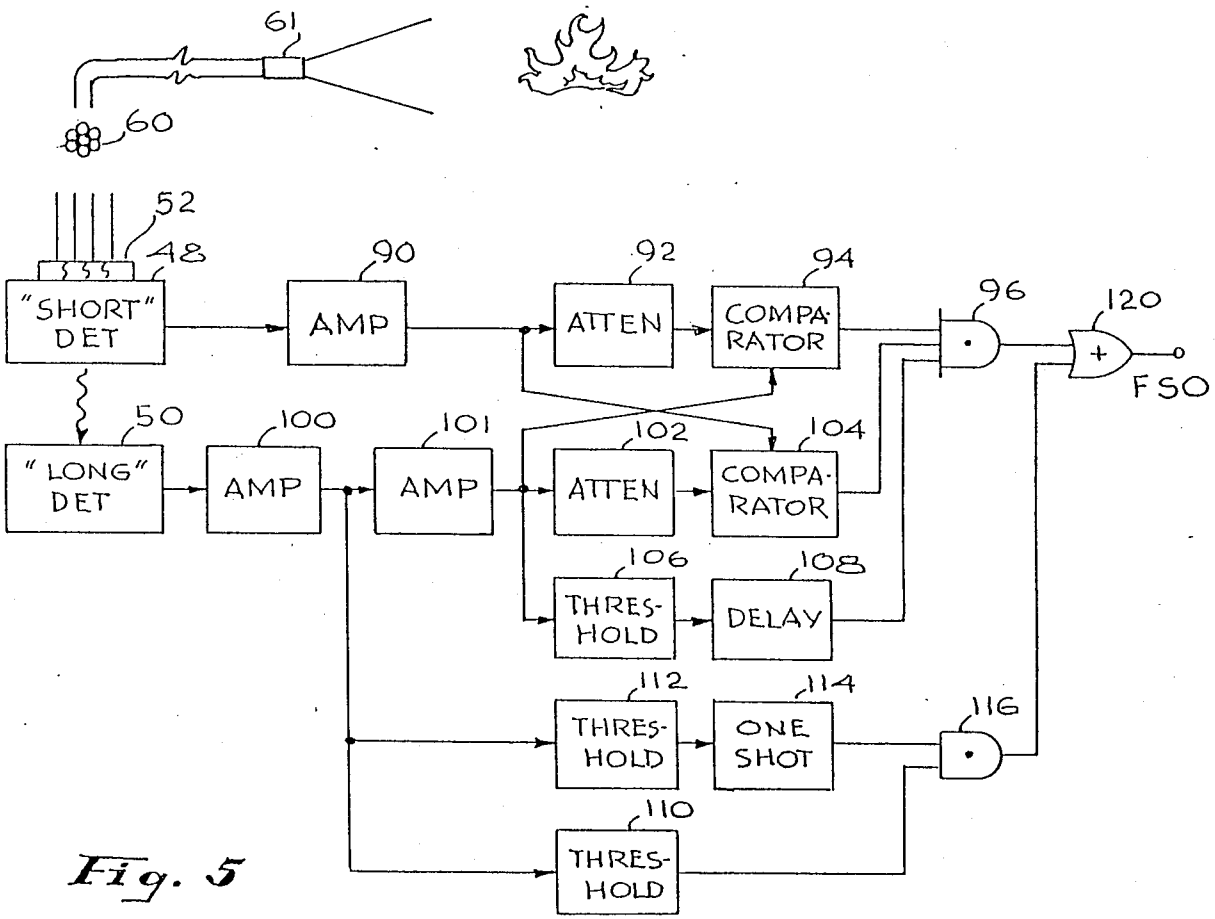
FIG. 5 is a schematic block diagram of another particular arrangement in accordance with the invention.

FIG. 5 represents an alternative embodiment of the invention which utilizes the ratio of the signals from the short and long wavelength detectors as the determinant for fire sensing. In FIG. 5, the input portion is the same as is shown in FIG. 4 with the fiber optics bundle 60, coupling optics 62 and detectors 48 and 50 being identical. The outputs of the detectors 48 and 50 are applied in two channels, as before. However, the upper channel comprises an amplifier 90, an attenuator 92 and a comparator 94 in series feeding a first AND gate 96. The lower channel comprises amplifiers 100, 101 in series with an attenuator 102 and comparator 104 also feeding the AND gate 96 at a second input. Cross-over connections from the first channel to the comparator 104 in the second channel and from the second channel to a comparator 94 in the first channel are provided as shown. A third signal path extends from the output of the amplifier 101 in the lower channel to a third input to the AND gate 96 and comprises a threshold stage 106 and delay stage 108. The delay stage 108 extends the trailing edge of any signal above the level of the threshold in threshold stage 106, equal to approximately 100 to 500 milliseconds. This provides additional false alarm immunity, since it requires that the outputs of the comparators 94 and 104 must be of sufficient duration to overlap the delayed output from the stage 108 before the output of the AND gate 96 will go high.

The long wavelength override in FIG. 5 is provided by the parallel threshold stages 110 and 112, the latter being connected in series with a one-shot multivibrator 114, which are connected to the output of the amplifier 100 and provide dual inputs to a second AND gate 116. The outputs of both AND gates 96 and 116 are applied to an OR gate 120, from which the fire sense output signal is derived. The one-shot multivibrator 114 in series with the threshold stage 112 prevents a response to large signals with a rise time which is greater than some predetermined limit, approximately one millisecond, thereby discriminating against false alarms from a continuous radiation source which increases gradually in intensity as contrasted with an abrupt increase in detected radiation such as might be caused by an incoming incendiary or an explosion.

The cross-over connections to the comparators 94, 104 which are respectively in series with attenuators 92, 102 provide the comparison of a signal in one channel with an attenuated signal in the other channel. The result is to establish a ratio range or window within which the signal levels from the short wavelength and long wavelength detectors must fall in order to develop a small fire detection signal. If the ratio of one channel signal to the other, or its reciprocal, is greater than some predetermined level, the corresponding comparator 94 or 104 fails to provide an output, thus blocking the transmission of any fire sensed signal. Only if the ratio of signals in the two channels is within a predetermined range (meaning that the radiation source is providing both short wavelength radiation and long wavelength radiation—a reliable test for true fire sensing) is a fire sense signal generated from both comparators 94, 104. The third path through the delay stage 108 insures that the duration of the small fire detection signals must be sufficient to make it highly likely that the detected radiation is truly a fire.

Figure 6:
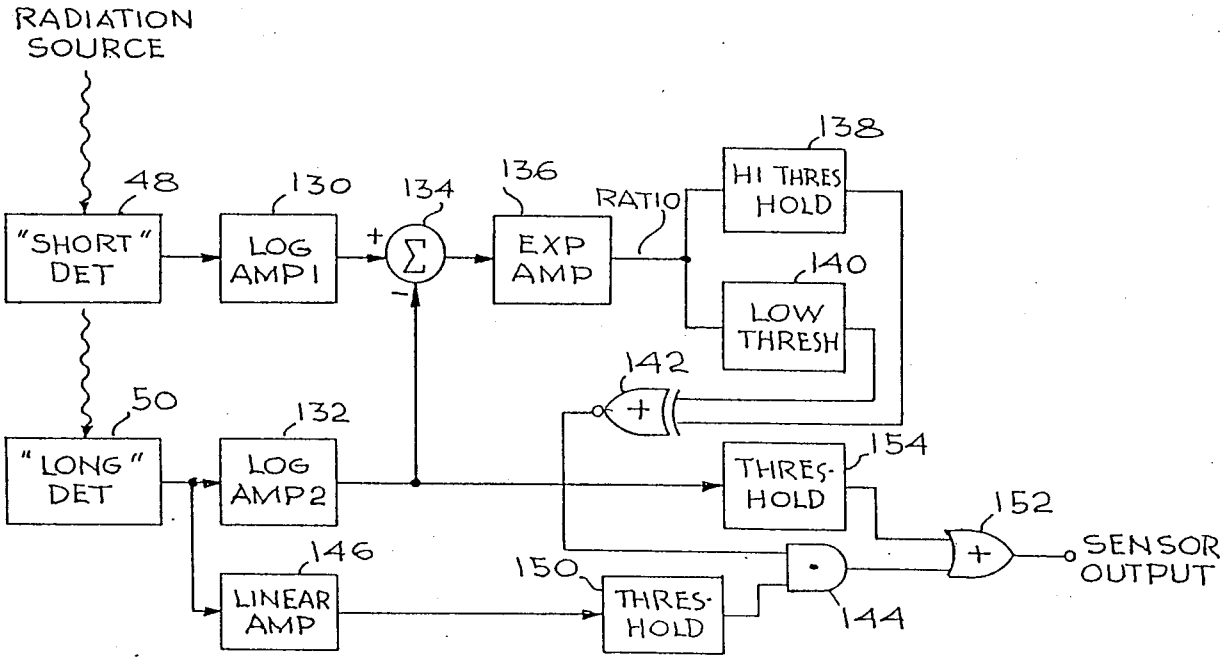
FIG. 6 is a schematic block diagram of a circuit arrangement which is similar in operational performance to that of FIG. 5.

FIG. 6 represents a ratiometric circuit which is comparable to that of FIG. 5. Short and long wavelength detectors 48, 50 are again coupled to parallel signal processing channels. However, the input amplifiers 130, 132 in these two channels are logarithmic amplifiers which provide the capability of greater dynamic range signal processing. This circuit may be useful where the ratio must be determined for short wavelength radiation and long wavelength radiation whose levels may have a range as great as 10,000:1. The outputs of the two logarithmic amplifiers 130, 132 are applied with opposite polarity to a summing stage 134 and the difference of the two logarithmic signals, having a one-to-one correspondence with a ratio, is applied to an exponential amplifier 136. The output signal of the exponential amplifier 136, which is a ratio, is applied in parallel to a high threshold stage 138 and a low threshold stage 140, the outputs of which are applied to an Exclusive NOR gate 142 to enable the AND gate 144 which also has an input from the threshold 150. The threshold 150 is in series with the linear amplifier 146 which is coupled directly to the output of the long wavelength detector 50. The output of the AND gate 144 is applied as one input to an OR gate 152. The output of the logarithmic amplifier 132 is applied to another threshold stage 154, the output of which is also coupled to the OR gate 152.

The circuit of FIG. 6 is responsive to a ratio of short wavelength to long wavelength signals which is characteristic of a fire. The two threshold stages 138, 140 insure that the ratio signal lies in the proper range which is characteristic of fires (not too low, as from a radiation heater, nor too high, as in radiation from a bright lamp). Only when there is no output from either the high threshold stage 138 or the low threshold stage 140 is the AND gate 144 enabled so that the long wavelength detector signal, of sufficient amplitude to pass the threshold stage 150, can be used to develop a sensor output from the OR gate 152. The output of the logarithmic amplifier 132 applied through the threshold stage 154 provides the long wavelength override, described in conjunction with the circuits of FIGS. 4 and 5. In this manner, the fire sense signal may be generated at the output of the OR gate 152 upon the occurrence of an explosion or penetration by an incendiary round.

Figure 7:
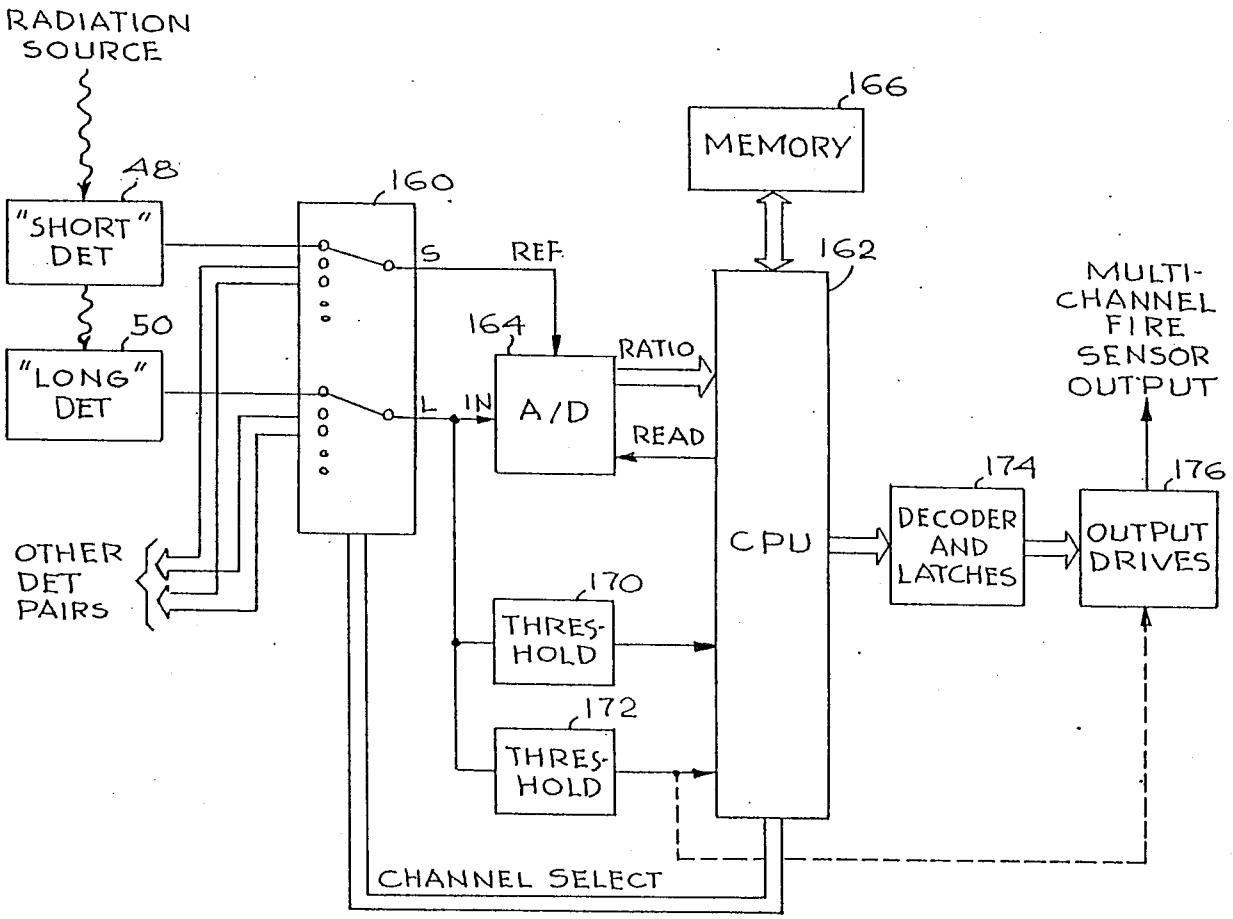
FIG. 7 is a schematic block diagram of still another alternative arrangement in accordance with the invention.

FIG. 7 represents a microprocessor as a central processing unit to provide an equivalent of the analog fire sensing circuits previously described. In FIG. 7, the short wavelength detector 48 and long wavelength detector 50 are shown as in the preceding circuits. However, the outputs of these detectors are coupled, together with outputs from other detector pairs, to a multiplexing switch 160 which is controlled by a central processing unit (CPU) 162. The signal paths from the multiplexer 160 are applied to an analog-to-digital (A/D) converter 164 and fed into the signal processing channels in the CPU 162. In this arrangement, the short wavelength detector signal is applied as a reference against which the long wavelength detector signal is compared, so that the output of the A/D converter 164 is a ratio which is read periodically and stored in computer memory 166. Two threshold stages 170, 172 are shown coupled between the long wavelength path from the multiplexer 160 and the CPU 162. These two threshold stages 170, 172 correspond to the threshold stages 150, 154, respectively, of the circuit of FIG. 6 or to comparable threshold stages in the other systems shown. In the event that the microprocessor utilized in the system does not have a sufficient clock rate to sample adequately for detection of explosions in multiple channels, the threshold stage 172 may have its output connected as shown by the broken line 173 so that the desired override protection may be afforded in the manner previously provided. In such a case, the long wavelength override would be provided by discrete circuit components as shown in any one of FIGS. 4–6.

The logic control of the CPU 162, provided by a control program which may be in software and/or in firmware, provides an equivalent operation of this circuit corresponding to any one of the other circuits shown and described hereinabove. The output of the CPU 162 is applied to appropriate decoder and latching circuitry 174 which in turn controls the output drives 176 which serve to provide the output when a fire is sensed at any detector pair coupled to the system. It is within the capability of those skilled in the computer art to be able to program the CPU in the system of FIG. 7 to control the system to operate in the manner described for any one of the analog systems of FIGS. 4–6. The microprocessor can be configured and programmed for small fire signal sensing in the manner disclosed in either of patent applications Ser. No. 592,611 of Mark T. Kern, entitled DUAL SPECTRUM FREQUENCY RESPONDING FIRE SENSOR, or Ser No. 768,539 of Mark T. Kern et al, entitled FIRE SENSOR STATISTICAL DISCRIMINATOR, both of which are assigned to the assignee of the present application. The disclosures of both of those applications are incorporated herein by reference, and resort thereto may be had for any disclosure which is required for the implementation of the system shown in FIG. 7.

Arrangements in accordance with the present invention provide fire sensing systems which present particular advantages for certain specialized applications, such as in situations where it is difficult physically locate the radiation sensors in remote locations or where conditions are such they cannot be tolerated by discrete sensor elements. Optical fibers utilized in the present invention are extremely rugged and can operate reliably in flame-temperature ambient environments. Systems such as those shown and described herein respond to explosions within two milliseconds. They respond to small, slow-growth fires in less than 100 milliseconds. The false alarm immunity compares favorably with that of alternative known systems. These systems are small, light in weight and low in power consumption. The systems provide particular benefits, as contrasted with other known systems, where multiple extreme-temperature areas need to be protected from fires and explosions without false alarms.

Although there have been described above specific arrangements of a fiber optic fire sensing system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A dual channel fire sensor system utilizing fiber optics comprising:

a first detector for generating an electrical signal in response to short wavelength radiation incident upon the first detector;

a second detector for generating an electrical signal in response to long wavelength radiation incident upon the second detector;

a plurality of optical fibers extending from the vicinity of said first and second detectors to remote locations to be monitored for the presence of fire or explosion;

means for coupling radiation transmitted along said optical fibers to said detectors;

first and second signal channels coupled respectively to said first and second detectors for processing signals from said detectors and developing an output signal indicative of a small fire upon the correlation within a predetermined range of signals from said first and second detectors; and a third signal channel coupled to only a selected one of said detectors and including means for developing an immediate output signal indicative of a fire in response to a predetermined large amplitude signal from the selected detector.

2. The system of claim 1 wherein said third channel includes a threshold stage coupled to the second detector to provide a long wavelength override fire sensor signal upon the occurrence of an explosion in a location being monitored.

3. The system of claim 1 wherein the plurality of optical fibers comprises individual fibers extending into corresponding compartments where fires are to be monitored.

4. The system of claim 3 wherein each individual optical fiber is directed adjacent its distal end in the direction of the major part of the compartment in which it terminates.

5. The system of claim 3 including terminating means coupled to the distal end of the optical fiber.

6. The system of claim 5 wherein said terminating means comprise means for adapting the field of view of the fiber to a selected viewing angle.

7. The system of claim 5 wherein said terminating means comprise a prism physically located within the compartment to be monitored by the associated optical fiber for gathering radiation from a radiation source within said compartment and directing it into the end of the associated fiber.

8. The system of claim 3 wherein the optical fibers are organized in bundles, each bundle containing fibers extending into compartments located within a section being monitored.

9. The system of claim 1 wherein the optical fibers are arranged in bundles, each bundle extending to a corresponding remote location to be monitored, the bundles being joined in a cable for coupling to said detectors.

10. The system of claim 1 wherein the first and second detectors are mounted within a housing along a common axis, and further including means for coupling the optical fibers to the first and second detectors along said common axis.

11. The system of claim 10 wherein radiation incident upon the second detector passes through the first detector and is conditioned upon the degree of opacity of the first detector.

12. The system of claim 11 wherein both of the first and second detectors are fabricated of silicon, wherein the response of the first detector extends over a range from about 0.4 to about 1.1 microns, and wherein the response of the second detector is a narrow spike signal centered at about 1.05 microns.

13. The system of claim 11 wherein the first detector comprises silicon and the second detector comprises a material from the group consisting essentially of silicon, lead sulphide, lead selenium, indium gallium arsenide and a thermopile material.

14. The system of claim 13 wherein the second detector comprises lead sulphide.

15. The system of claim 13 wherein the second detector comprises lead selenium.

16. The system of claim 13 wherein the second detector comprises indium gallium arsenide.

17. The system of claim 13 wherein the second detector comprises a thermopile material.

18. The system of claim 11 wherein the first detector comprises germanium and the second detector comprises indium arsenide.

19. The system of claim 18 further including a window element in said housing, the window being of colored glass selected to control the response bands of said detectors within predetermined limits.

20. The system of claim 11 wherein the first detector comprises germanium and the second detector comprises a thermopile material.

21. The system of claim 1 wherein the optical fibers are selected to provide transmission of radiation within a wavelength range cutting off at a predetermined wavelength.

22. The system of claim 21 wherein said predetermined wavelength is approximately 12 microns.

23. The system of claim 21 wherein said predetermined wavelength is approximately 5 microns.

24. The system of claim 21 wherein said predetermined wavelength is approximately 2.3 microns.

25. The system of claim 21 wherein the optical fibers are selected to provide a lower limit cut-on wavelength of approximately 0.4 microns.

26. The system of claim 25 including means for maintaining a wavelength separation between the wavelength range of the first detector and the wavelength range of the second detector.

27. The system of claim 26 wherein said last-mentioned means comprises an optical filter element between the first and second detectors having a predetermined filter response.

28. The system of claim 2 wherein each of said first and second channels comprises a pair of amplifiers in series with a threshold stage, and further including an AND gate having inputs coupled to the outputs of said threshold stages and to a comparator stage, the comparator stage being coupled to compare signals in said first and second channels and to provide a disabling signal to said AND gate in response to signals in said two channels which are outside of a predetermined range of each other.

29. The system of claim 28 further including an OR gate coupled to receive as inputs the output of said AND gate and the output of the threshold stage in said third channel to develop an output signal indicating the sensing of a fire upon the occurrence of an active condition from either of said inputs.

30. The system of claim 2 wherein each of said first and second channels includes amplifier means in series with an attenuator and a comparator, each comparator being coupled as an input to an AND gate, and bilateral means for applying signals from the amplifier means of each channel to the comparator of the other channel for comparison with an attenuated signal of that channel, each comparator providing an input signal to the associated AND gate only upon the occurrence of a predetermined ratio between the signals applied to said given comparator.

31. The system of claim 30 wherein output signals are required from both of said comparators in order to develop signal conditions indicative of the detection of radiation from a small fire.

32. The system of claim 31 further including an additional signal path comprising a threshold stage and a delay stage in series between the output of the amplifier means in one of said channels and a third input of said AND gate to inhibit the AND gate from generating an output signal in the absence of input signal from radiation of less than a predetermined duration and a predetermined magnitude.

33. The system of claim 32 wherein said third channel comprises a first circuit path having a first threshold stage in parallel with a second circuit path having a second threshold stage in series with a one-shot multivibrator, the outputs of both of said first and second circuit paths being applied as inputs to a second AND gate in order to limit the generation of said immediate output signal to input signals having a rise time of less than a predetermined interval.

34. The system of claim 33 further including an OR gate coupled to receive the outputs of both of said AND gates and to generate an output signal indicating the sensing of a fire upon the detection of either a small fire or an explosion.

35. The system of claim 2 wherein each of said first and second channels includes a logarithmic amplifier coupled to a corresponding detector, and further including a summing stage coupled to receive the outputs of said logarithmic amplifiers and generate a ratio signal which corresponds to the ratio of signals from said detectors and means for developing a signal indicating sensing of a small fire upon said ratio signal being within a predetermined range.

36. The system of claim 35 further including an additional circuit path comprising a threshold stage and amplifier means coupled to one of said detectors for generating a signal in response to radiation in excess of a predetermined threshold level, and gate means coupled to the output of the first and second channels and the output of the third circuit path to develop a fire sensed signal upon the concurrence of signals at both of said outputs.

37. The system of claim 36 further including a pair of respective high and low threshold stages coupled in parallel to receive said ratio signal, said high and low threshold stages having outputs coupled in parallel to an Exclusive NOR gate to provide the output from the first and second channels.

38. The system of claim 37 wherein the third channel comprises a fourth threshold stage coupled between the output of one of said logarithmic amplifiers and an OR gate to provide a signal indicative of the sensing of a fire upon the detection of radiation in excess of a predetermined threshold level.

* * * * *